US006698740B1

(12) United States Patent
Slagle

(10) Patent No.: US 6,698,740 B1
(45) Date of Patent: Mar. 2, 2004

(54) POWER-ACTUATED VISE JAW

(76) Inventor: Tommy J. Slagle, P.O. Box 1846, Manhattan, KS (US) 66505

( * ) Notice: Subject to any disclaimer, the term of this patent is extended or adjusted under 35 U.S.C. 154(b) by 0 days.

(21) Appl. No.: 10/260,201

(22) Filed: Sep. 27, 2002

(51) Int. Cl.[7] ..... B25B 1/24
(52) U.S. Cl. ..... 269/277; 269/32
(58) Field of Search ..... 269/282, 283, 269/277, 278, 234, 266, 217, 233, 32

(56) References Cited

U.S. PATENT DOCUMENTS 2,620,693 A * 12/1952 Eslick ..... 269/32
4,208,045 A * 6/1980 Rowe et al. ..... 269/234
4,418,899 A * 12/1983 Zimmermann et al. ..... 269/32
4,518,476 A * 5/1985 Delony et al. ..... 269/234
4,618,131 A * 10/1986 Campisi et al. ..... 269/32

* cited by examiner

*Primary Examiner*—Robert C. Watson
(74) *Attorney, Agent, or Firm*—Mark E. Brown

(57) ABSTRACT

A power-actuated jaw is provided for a vise including first and second vise jaws. The actuated jaw includes a force transfer mechanism adapted for transferring a force from a linear actuator, such as a pneumatic piston-and-cylinder unit, through pivoting and sliding subassemblies. The sliding subassembly mounts a jaw contact member and pushes same between open/retracted and closed/extended positions. A compressed air source is connected to the piston-and-cylinder unit through a three-way valve for cycling the actuated jaw through load/unload cycles.

20 Claims, 11 Drawing Sheets

OPEN/RETRACTED

CLOSED/EXTENDED

OPEN/RETRACTED

CLOSED/EXTENDED

POWER-ACTUATED VISE JAW

FIELD OF THE INVENTION

The present invention relates generally to clamping equipment, and in particular to a power-actuated vise jaw, which cycles rapidly between open/retracted and closed/extended positions for workpiece loading and unloading.

DESCRIPTION OF THE PRIOR ART

The prior art includes a wide variety of equipment and tools designed for clamping, gripping and securing various types of workpieces. For example, vises are available in various sizes and configurations for securing respective workpieces during manufacturing, fabricating, cutting, finishing, assembly and other operations requiring stability and secure positioning. A common prior art vise configuration includes fixed and movable jaws for engaging the workpiece and a threaded shaft mechanism for reciprocating the jaws when turned. Turning can be accomplished manually with a handle, or with a drive motor.

Certain types of manufacturing and fabrication operations involve repetitive steps whereby identical or similar parts are produced. For example, mass production manufacturing techniques typically utilize quantities of standardized components in the assembly of finished goods. The objectives of mass production manufacturing are generally to achieve efficiency, economy, consistency and quality through the effective application of modern manufacturing equipment and techniques. For example, "must-have" and "just-in-time" manufacturing management strategies are currently popular because of their potential for streamlining production by reducing labor costs and controlling inventory and equipment capital costs more efficiently. Manufacturers in general are under pressure to operate more efficiently by making more efficient use of labor, raw materials and tooling. In the current "global economy", manufacturers are continually urged to operate more efficiently by doing "more with less".

In machining, fabrication and assembly, commercial vises are in widespread use. Generally speaking, the applicable design objectives include secure clamping with a cost-effective device, fast unload/load cycling, operator safety and comfort, and efficient space utilization to accommodate assembly lines crowded with equipment and materials. Prior art vises, which operate manually with hand cranks, tend to be relatively inefficient in operation because operators must manually tighten and loosen the jaws on each individual workpiece for each load/unload cycle. Moreover, operators tend to become fatigued and can incur repetitive motion injuries. Such conditions tend to increase labor costs and reduce quality and consistency in mass production.

Power-driven vises have also been devised, but tend to be relatively complicated, expensive and/or inefficient from a cost point of view. Moreover, it may be difficult for a manufacturer to justify replacing equipment, such as production line vises, which operate satisfactorily, even if they are somewhat inefficient. Therefore, a retrofit solution, which retains the original equipment in place and adds a new component for greater efficiency and improved operation, has considerable appeal to many manufacturers, machine shops and other establishments which utilize vises in their operations.

Air compressors are commonly installed in manufacturing facilities. They provide the compressed air necessary for powering many tools and pieces of equipment. Therefore, driving a power-actuated vise jaw with compressed air is desirable because it would enable existing compressors and air distribution systems to be effectively utilized in many manufacturing facilities.

Heretofore there has not been available a power-actuated vise jaw with the advantages and features of the present invention.

SUMMARY OF THE INVENTION

In the practice of the present invention, a power-actuated jaw is provided for a vise. The actuated jaw includes a housing adapted for mounting on the movable jaw of the existing vise after the original movable jaw contact member is removed. A force transfer mechanism is located generally within the housing and includes a sliding force transfer subassembly and a pivoting force transfer subassembly, which cumulatively transfer a longitudinal force from a linear actuator mounted on the housing to a transverse force, and finally to a longitudinal force advancing a movable contact member into engagement with a workpiece. The linear actuator can comprise a pneumatic piston-and-cylinder unit mounted on the housing. The actuated jaw provides relatively fast load/unload cycles for workpieces.

DETAILED DESCRIPTION OF THE PREFERRED EMBODIMENTS

I. Introduction and Environment

As required, detailed embodiments of the present invention are disclosed herein; however, it is to be understood that the disclosed embodiments are merely exemplary of the invention, which may be embodied in various forms.

Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
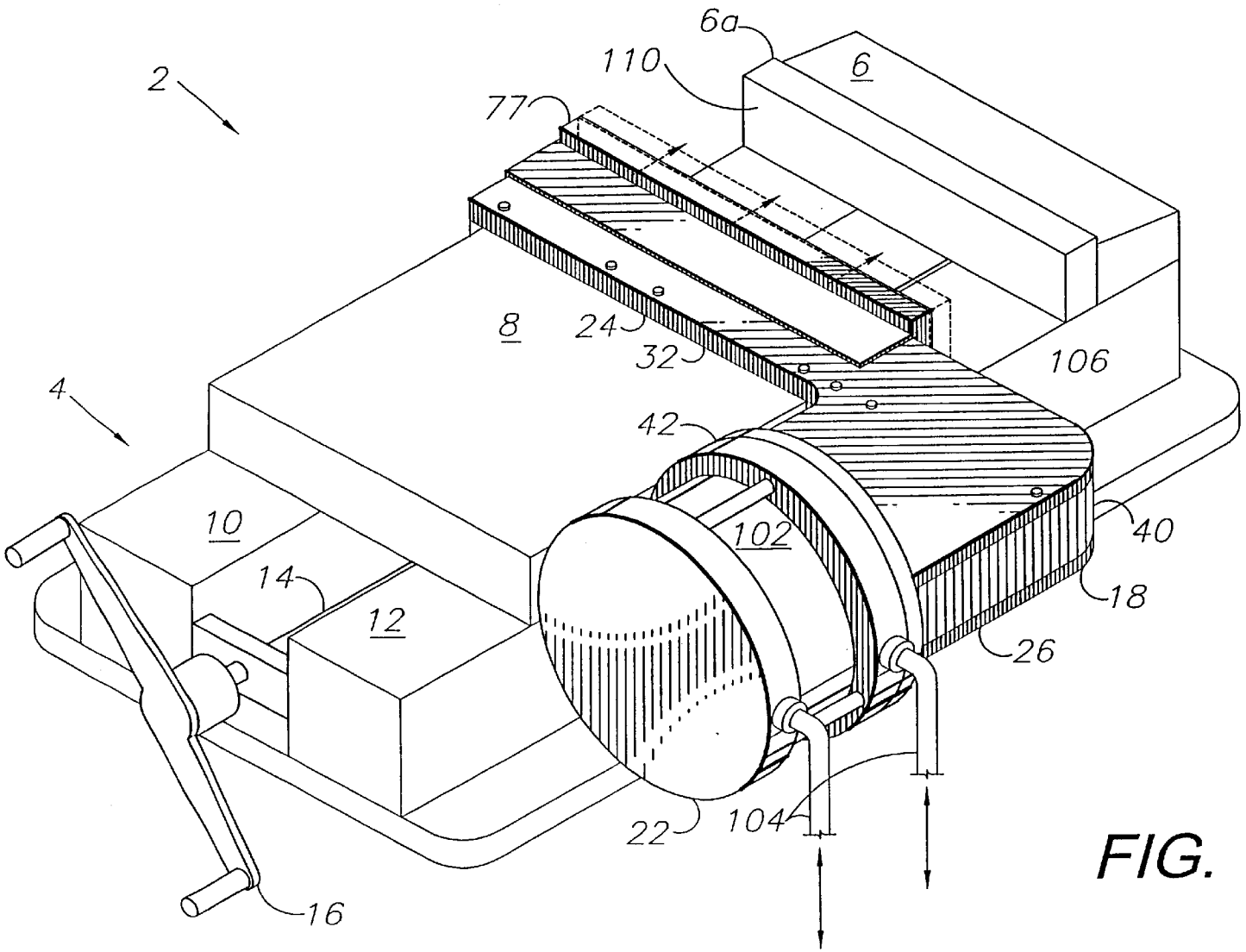
FIG. 1 is an upper, front, right side perspective view of a vise with the power-actuated jaw embodying the present invention.

Certain terminology will be used in the following description for convenience in reference only and will not be limiting. For example, up, down, front, back, right and left refer to the invention as oriented in FIG. 1. The words "inwardly" and "outwardly" refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 2 generally designates an actuated jaw embodying the present invention. Without limitation on the generality of useful applications of the actuated jaw 2, it is shown retrofit on an existing vise 4 with original fixed and moveable jaws 6 and 8, which include original jaw contact members 6*a*, 8*a*. The original vise can comprise, for example, a type made by Kurt Manufacturing Company of Minneapolis, Minn. 55421. However, other manufacturers' vises can also be retrofit with the actuated jaw 2 of the present invention. Moreover, a number of manufacturers produce vises which are similar to those made by Kurt Manufacturing Company and interchange parts therewith. The actuated jaw 2 of the present invention, therefore, can be configured for retrofit applications on a number of different vises with little or no modification.

Figure 1A:
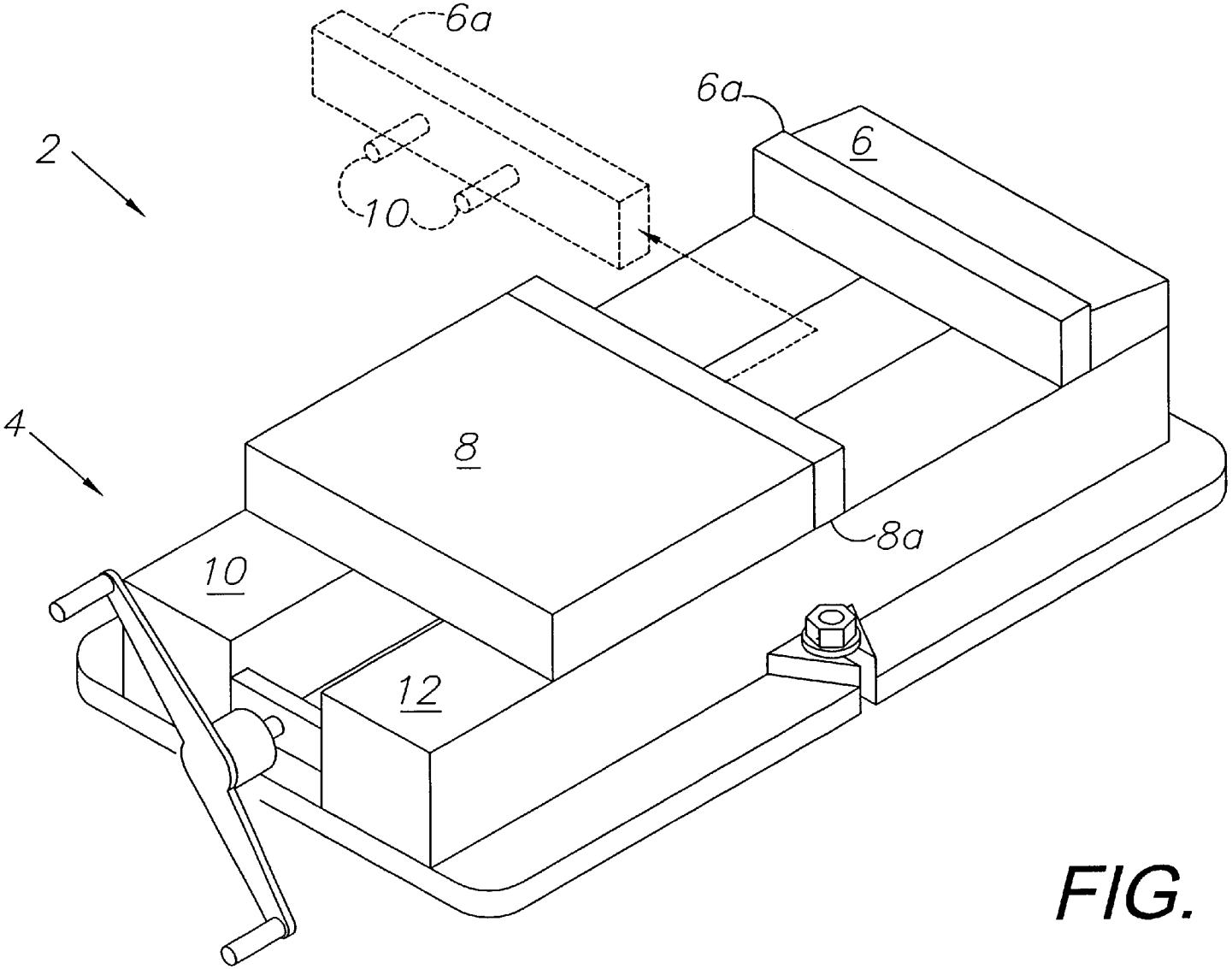
FIG. 1*a* is an upper, front, right side perspective view of a prior art vise, showing the movable jaw contact member thereof in dashed lines being removed.
Figure 2:
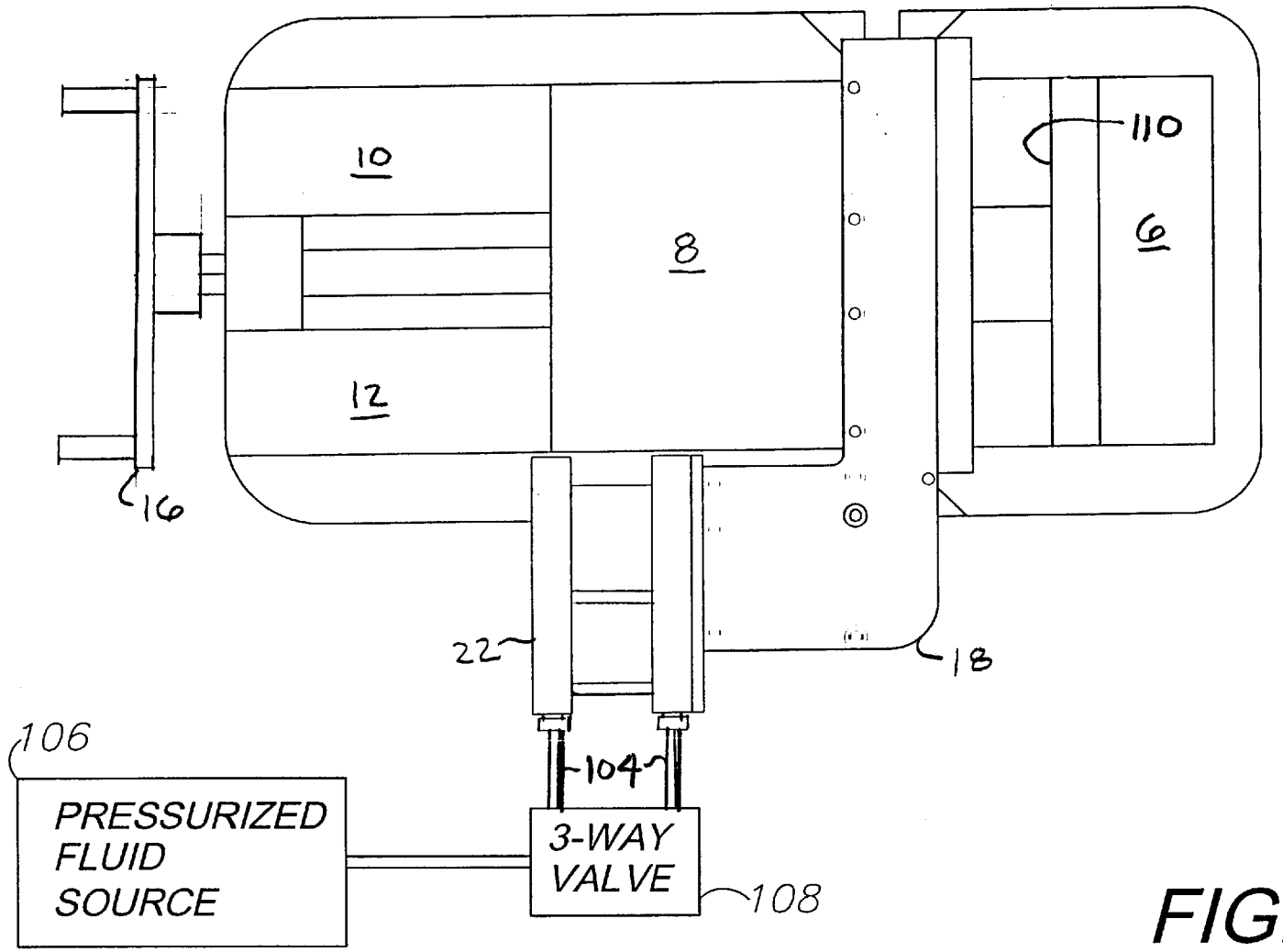
FIG. 2 is a top plan view of the vise with the actuated jaw, including a pressurized fluid (compressed air) source and a three-way valve for actuating the jaw.

The original movable jaw contact member 8*a* of the vise 4 is secured to the movable jaw 8 by a pair of mounting bolts 10 which, when removed, permit removal of the original movable jaw contact member 8*a* (FIG. 1*a*). The vise 4 includes a pair of rails 12 along which the movable jaw 8 is adapted for sliding towards and away from the fixed jaw 6. Movement of the movable jaw 8 is controlled by a threaded rod 14 mounting a hand crank 16. The fixed jaw 6 can be repositioned on the rails 12, but generally remains stationary in a clamping operation.

The actuated jaw 2 generally comprises a housing 18, a force transfer mechanism 20 and a linear actuator 22.

II. Housing 18

The housing 18 includes first/upper and second/lower housing plates 24, 26, which are positioned in generally parallel, spaced relation and form a housing receiver 28 therebetween, which generally contains the transfer mechanism 20. The housing 18 includes a proximate/front end 32 positioned generally against the vise movable jaw 8, a distal/back end 34, and first and second sides 36, 38. A housing extension 40 projects generally outwardly and forwardly from the proximate end 32 at the second side 38 and terminates at an extension end flange 42, which amounts the linear actuator 22.

Figure 7:
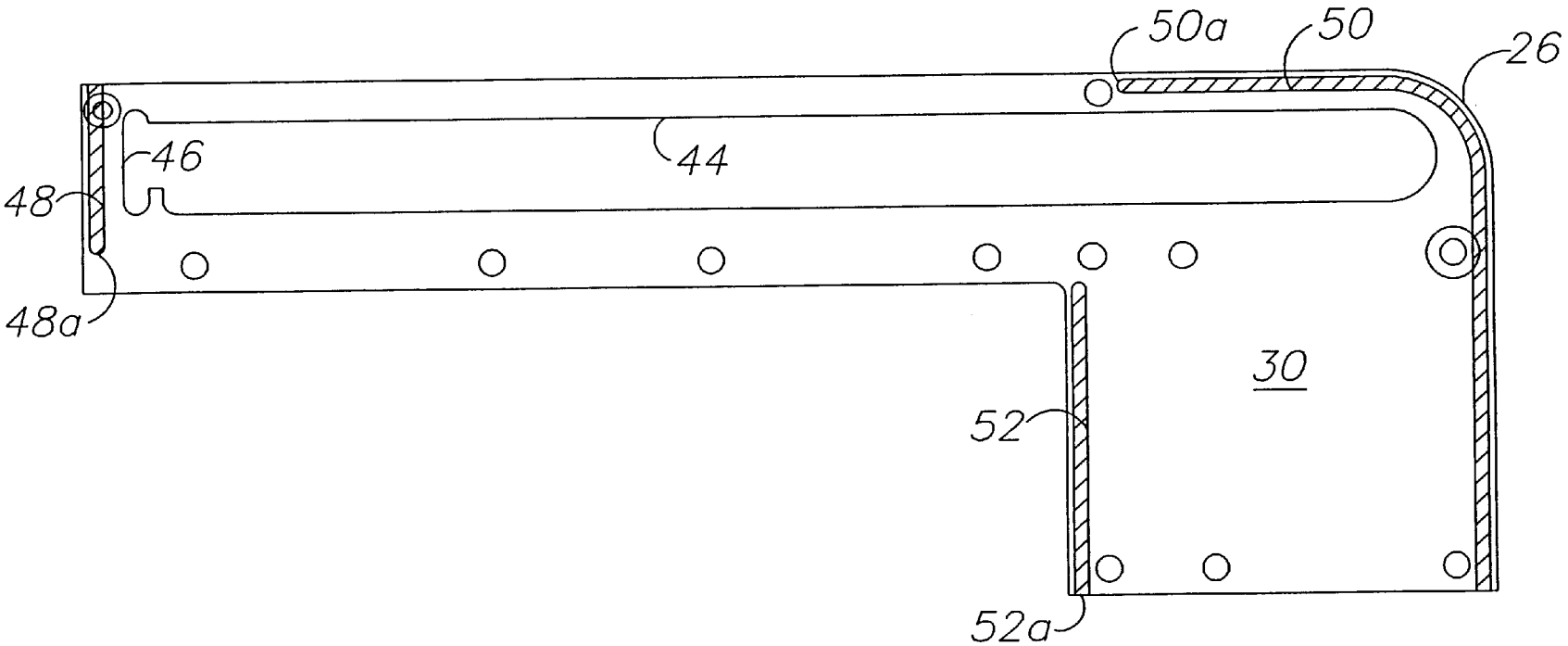
FIG. 7 is a top plan view of a lower housing plate.
Figure 8:
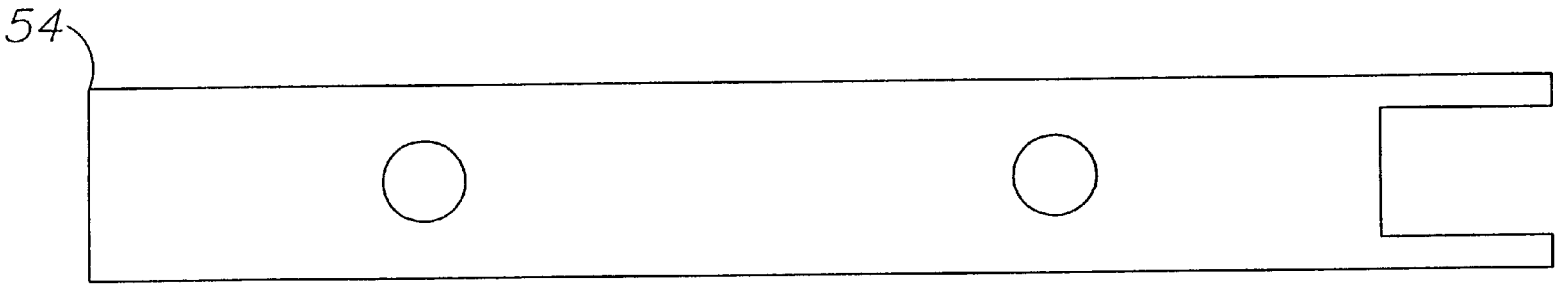
FIG. 8 is a front elevational view of a housing mounting plate.

FIG. 7 is a top plan view of an inside face 30 of the lower housing plate 26. The inside face of the upper housing plate 24 is similar. A slide bar channel 44 is open at the lower plate inside face 30 and extends in generally parallel relation to the housing ends 32, 34. The channel 44 terminates at a roller receiver 46 located in proximity to the housing first side 36. The plate inside face 30 is grooved for chip guards at 48 (first side chip guard 48*a*), 50 (distal end/second side chip guard 50*a*) and 52 (extension inner side chip guard 52*a*).

Figure 5:
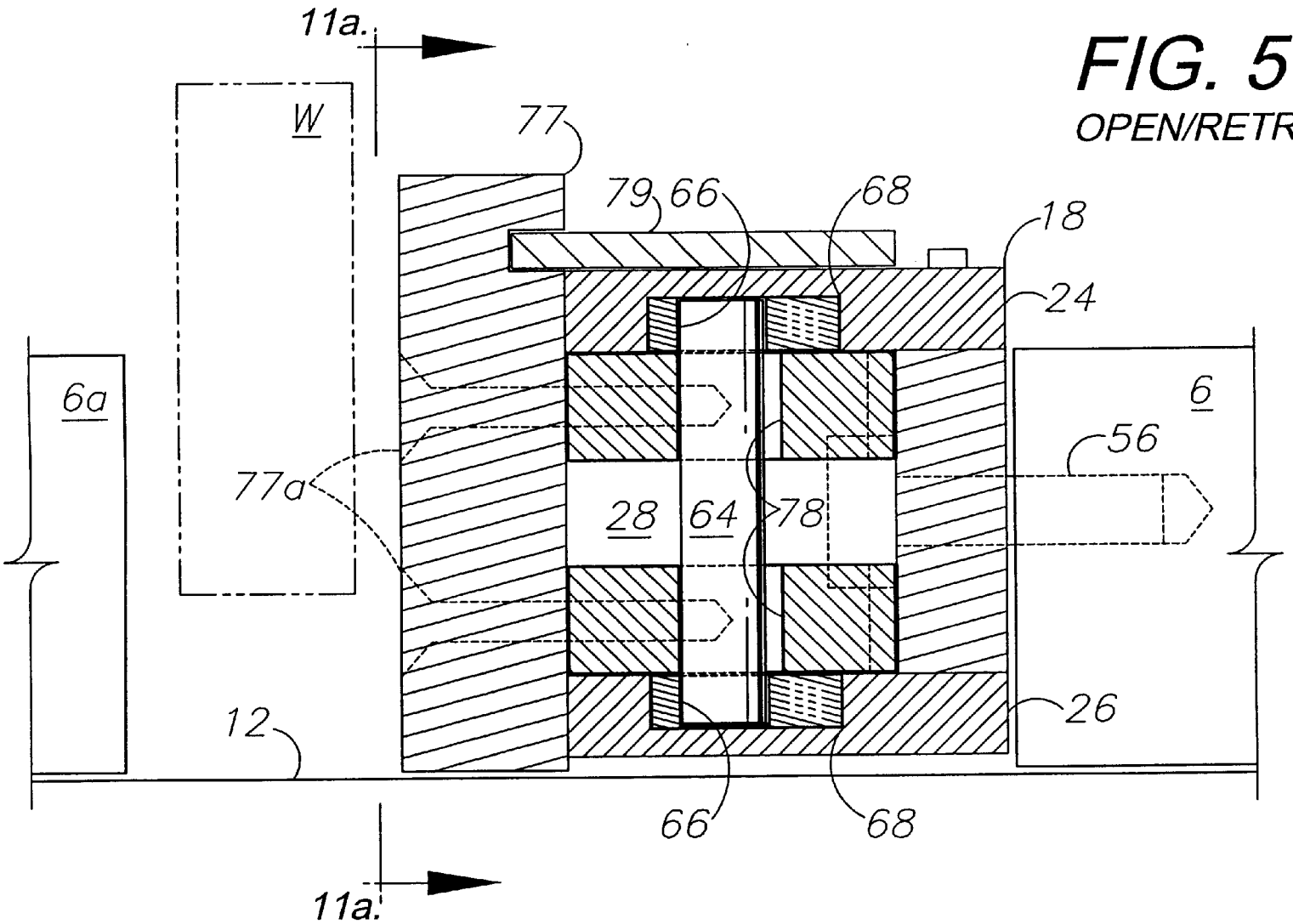
FIG. 5 is a vertical, cross-sectional view of the vise, taken generally along line 5—5 in FIG. 3 and showing the actuated jaw in an open/retracted position.
Figure 6:
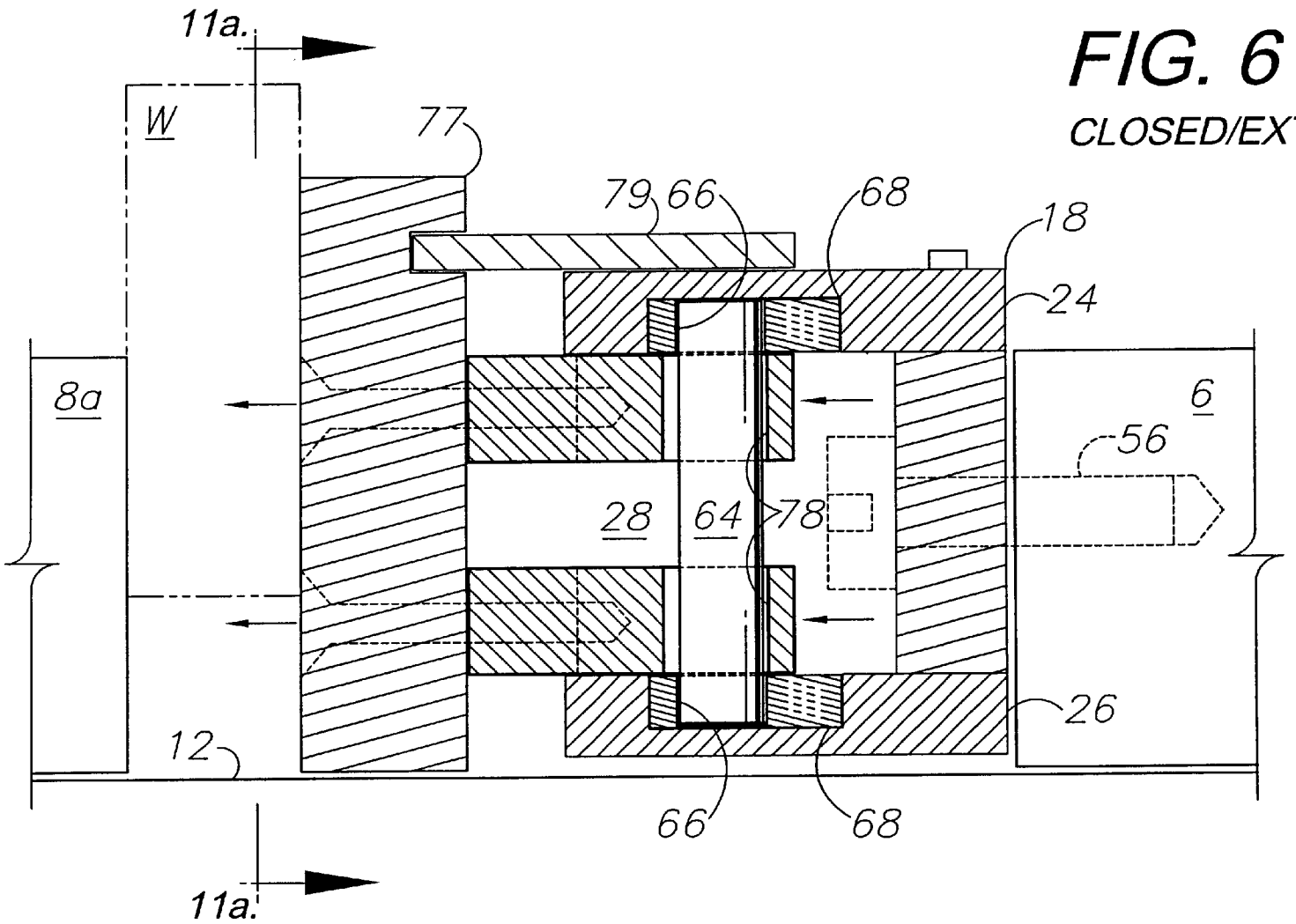
FIG. 6 is a vertical, cross-sectional view of the vise, taken generally along line 6—6 in FIG. 4 and showing the actuated jaw in a closed/extended position.

As shown in FIGS. 5 and 6, a mounting plate 54 is located between the housing plates 24, 26, and extends generally between the housing first side 36 and the extension 40 adjacent to the housing proximate end 32. The mounting plate 54 receives a pair of Allen bolts 56, which have the same bolt pattern as the mounting bolts 10 which secured the removed movable jaw plate 8*a*. The bolts 56 are threaded into the existing receivers in the vise movable jaw 8.

III. Force Transfer Mechanism 20

Figure 9:
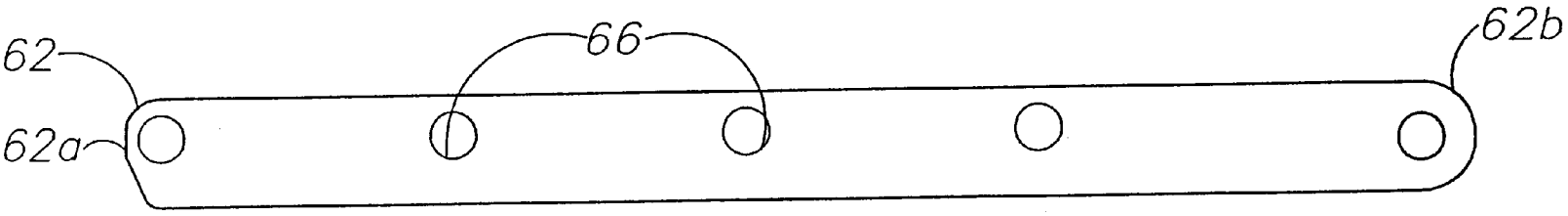
FIG. 9 is a front elevational view of a slide bar.

The force transfer mechanism 20 generally comprises a sliding force transfer subassembly 58 and a pivoting force transfer subassembly 60. The sliding force subassembly 58 includes a pair of slide bars 62 (FIG. 9), each having first and second ends 62*a*, 62*b*. The slide bars 62 are positioned in parallel, spaced relation within the housing receiver 28 and are longitudinally, slidably received in the slide bar channels 44 respectively. Multiple (e.g., four are shown) guide pins 64 are received at their ends in respective guide pin receivers 66 formed in the slide bars 62 (FIGS. 5 and 6). The pins 64 extend between the slide bars 62 across the housing receiver 28.

Figure 10:
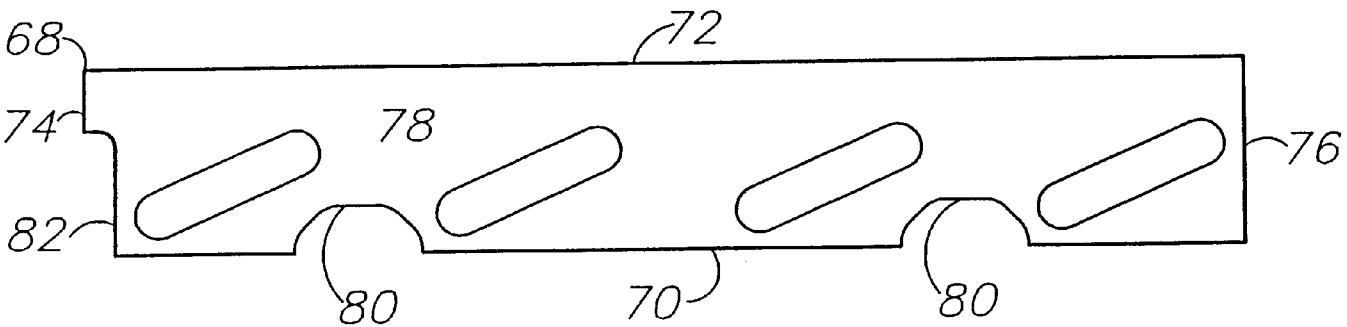
FIG. 10 is a front elevational view of a push bar.
Figure 11B:
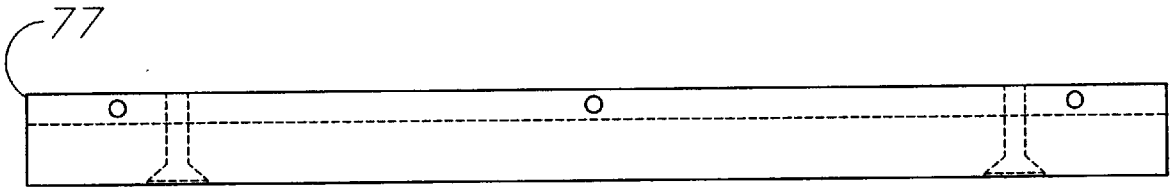
FIG. 11*b* is a top plan view of the workpiece contact member.
Figure 11A:
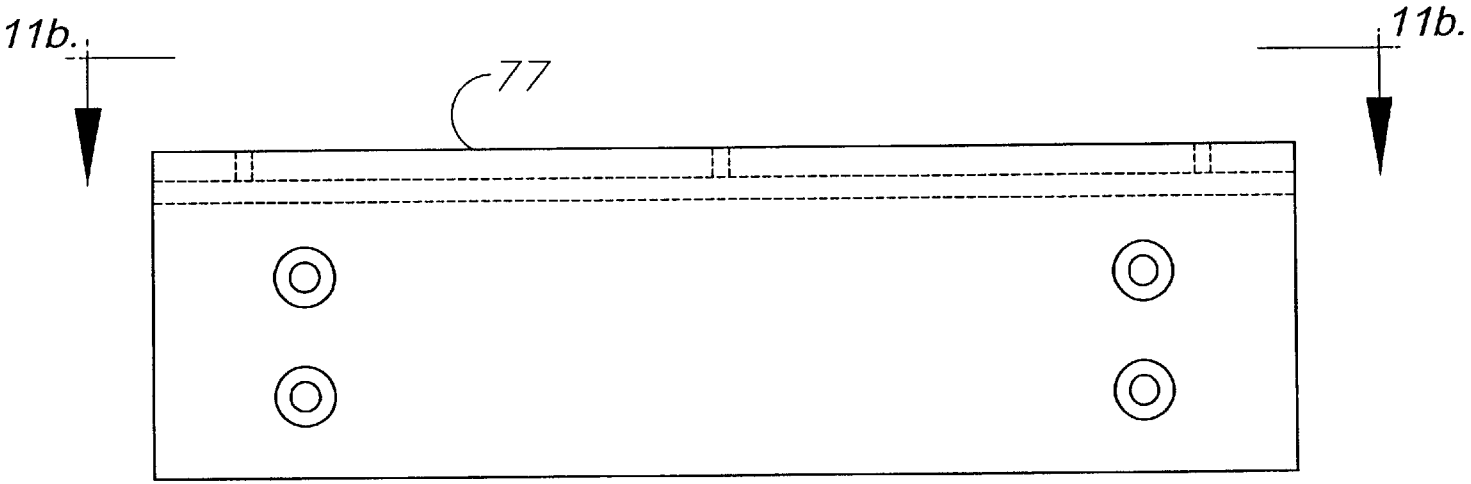
FIG. 11*a* is a rear elevational view of a workpiece contact member of the actuated jaw, which replaces the original movable jaw contact member.

The sliding force transfer subassembly also includes a pair of push bars 68, each having proximate and distal edges 70, 72 (corresponding to the housing proximate and distal ends 32, 34 respectively) and first and second ends 74, 76 (FIG. 10). Multiple (e.g., four are shown) guide slots 78 are formed in the push bars 68 and extend generally diagonally across same. The push bars 68 are notched at 80 to receive the heads of the mounting bolts 56 and include recesses 82 at their respective first sides 74. With the sliding force transfer subassembly 58 assembled, the push bars 68 are located inboard from the slide bars 62 with the guide pins 64 slidably received in respective guide slots 78. Multiple first side roller bearings 84 are captured in the roller receivers 46 of the housing plates 24, 26. The first side roller bearings 84 engage the push bars 68 within the recesses 82 thereof. A second side roller bearing 86 is captured in the housing plates 24, 26 adjacent to the housing distal end 34 in engagement with the push bar second sides 76. The roller bearings 84, 86 facilitate extending and retracting the push bars 68.

A jaw contact member 77 (FIGS. 1*a* and 1*b*) is mounted on the push bars 68 by recessed mounting screws 77*a*. A guard 79 is mounted on the jaw contact member 77 and extends forwardly therefrom in protective, covering relation over a gap formed by extending the push bars 68.

Figure 3:
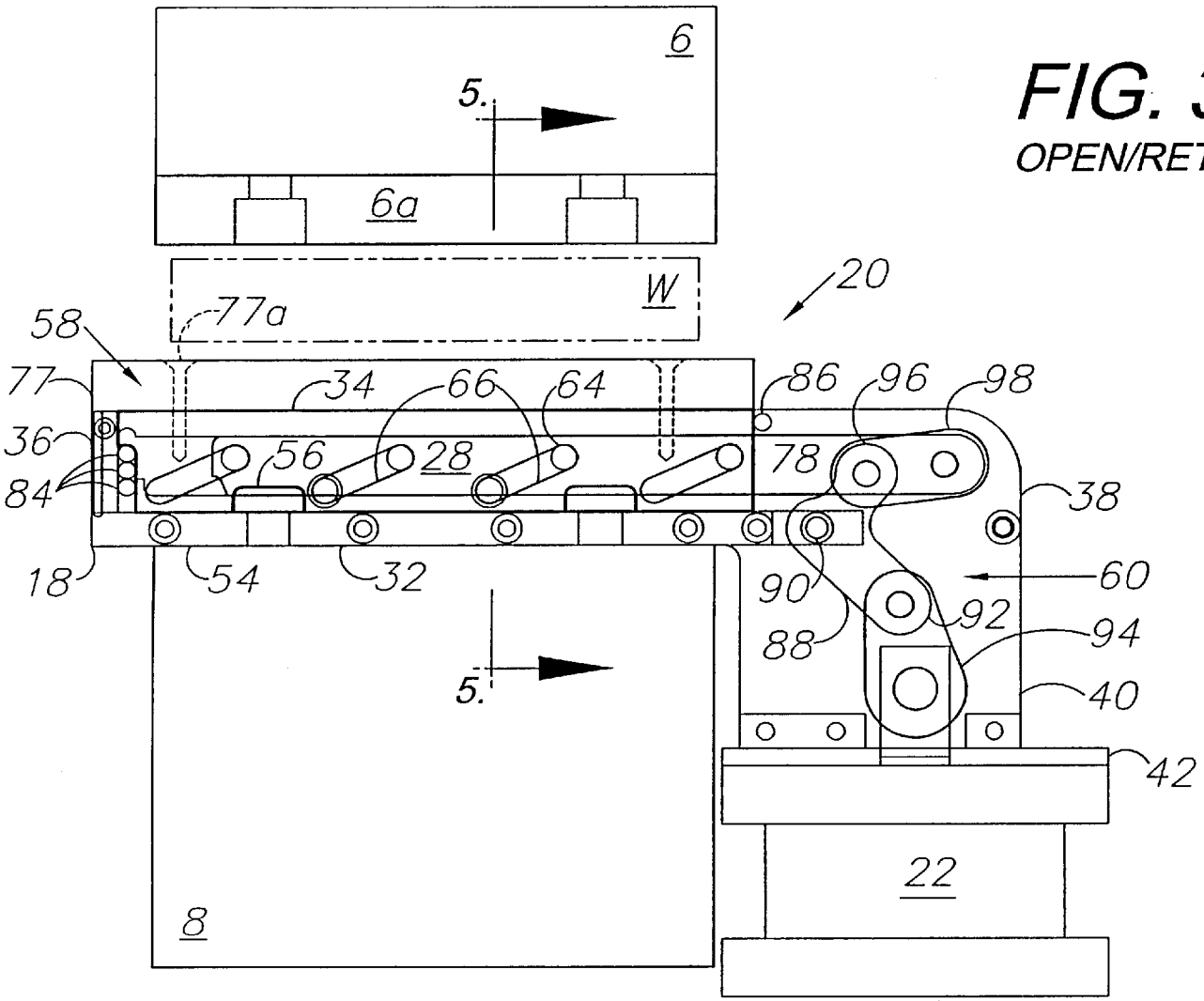
FIG. 3 is a top plan view of the vise, particularly showing the actuated jaw in an open/retracted position.
Figure 4:
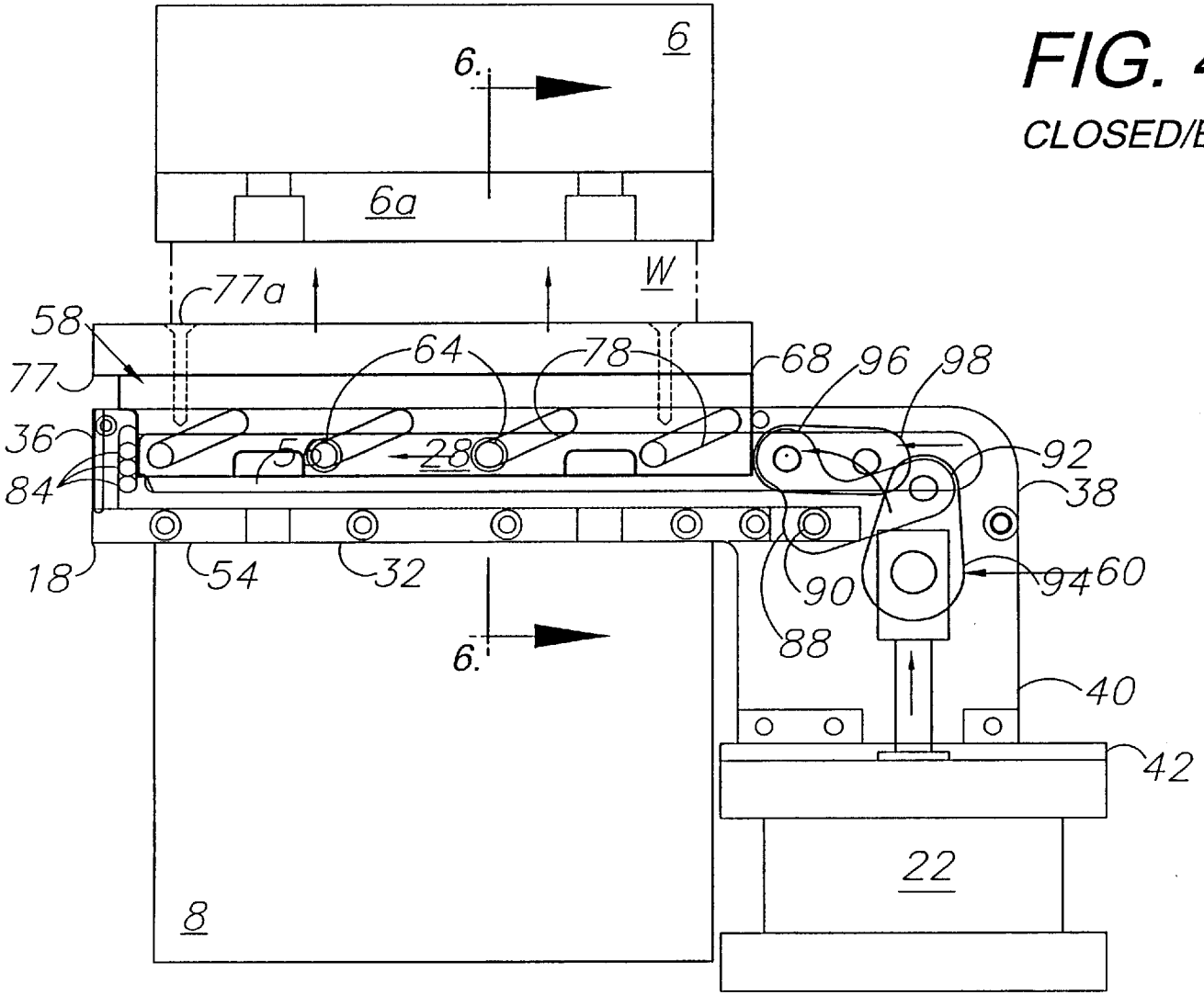
FIG. 4 is a top plan view of the vise, particularly showing the actuated jaw in an open/retracted position.

The pivoting force transfer subassembly 60 converts a linear fore-and-aft force from the linear actuator 22 to a transverse force applied to the slide bars 62. As shown in FIGS. 3 and 4 (movement arrows are shown in FIG. 4), a pivot arm 88 is pivotally mounted on the second/right side of the mounting plate 54 by a pivot pin 90. The pivot arm 88 includes a proximate end 92 connected to an actuator linkage 94, which in turn is connected to the linear actuator 22. A crank distal end 96 is connected to slide linkage 98, which in turn is connected to the slide bars 62 at their second/right ends 62*b*.

IV. Linear Actuator 22

The linear actuator 22 can comprise any suitable device for applying a linear (i.e., fore-and-aft) force to the pivoting subassembly 60. For example, a suitable pneumatic piston-and-cylinder unit 102 is available from the Parker Hannifin Corporation of Cleveland, Ohio 44112. The piston-and-cylinder unit 102 mounts on the housing extension end flange 42 and is double-acting for powering both extension and retraction strokes. A pair of air supply lines 104 conveys compressed air to the respective ends of the piston-andcylinder unit 102 from a source 106 through a three-way valve 108. The three-way valve 108 can comprise any suitable valve, and can be operated by a foot pedal, hand lever, electric switch connected to a solenoid-operated valve, programmable controller, etc.

Various other force application means can be utilized in place of the pneumatic piston-and-cylinder unit 102, such as a single-acting pneumatic cylinder with a spring return. Other examples include hydraulic and electric (e.g., solenoid) devices, which are well-known and commercially available. Still further, electric, pneumatic or hydraulic motors driving screw-threaded rods can be used. Moreover, a manual force application mechanism can be employed whereby an operator would move a lever or some other mechanism to push the slide bars 62 transversely. Still further, an actuator can be located at one side of the housing 18 and connected directly to the slide bars 62, thus eliminating the pivoting subassembly linkage 60. Further still, multiple actuated jaws could be ganged and actuated by a common linear actuator.

V. Installation and Operation

Installation of the actuated jaw 2 generally involves removing the existing movable jaw contact member 8a by removing the mounting bolts 10. The actuated jaw 2 is installed with its jaw contact member 77 removed, thereby providing access to the housing receiver 28. The Allen bolts 56 are preferably already in place in the mounting plate 54 and align with the existing bolt pattern on the existing vise movable jaw 8. The Allen bolts 56 can be tightened with a suitable Allen wrench socket inserted in the housing receiver 28. The jaw contact member 77 can be installed with the screws 77*a*, which extend through same and into the push bars 68. The guard 79 is also installed and generally covers gaps formed at the top and the first/left side as the actuated jaw 2.

The actuated jaw 2 can be utilized in conjunction with the vise crank 16 for fine/final and rough/initial positioning respectively. For example, repetitive machining generally involves relatively short, repetitive movements of the vise jaws to load and unload workpieces W. During initial setup, an operator typically advances the movable jaw 8 to within a half-inch or so of its final, closed position on the workpiece W, using the crank 16.

With the actuated jaw 2 in its open/retracted position (FIGS. 3 and 5), the workpiece W is placed and the operator opens the valve 108, extending the piston-and cylinder unit 102, which advances the actuator linkage 94 and rotates the pivot arm 88 counterclockwise. The pivot arm 88 pushes the slide bars 62 to the left via the slide linkage 98. It will be appreciated that the components of the pivoting assembly 60 are suitably pivotally interconnected to allow relative rotation therebetween, as shown in FIGS. 3 and 4. The pivoting assembly 60 generally functions to convert a linear force in a first direction (fore-and-aft), imparted by the linear actuator 22, to a transverse (side-to-side) force in a second direction.

The sliding subassembly 58 converts the transverse, second direction force from the pivoting subassembly 60 to a fore-and-aft first direction force which opens and closes the actuated jaw 2. Thus, the cumulative action of the sliding and pivoting subassemblies 58, 60 is transferring the first direction force from the linear actuator 22 to another, parallel first direction force at the contact member 77, with the subassemblies 58, 60 providing suitable leverage and mechanical advantage based on their geometries and ranges of movement.

Sliding the slide bars 62 to the left pushes the-guide pins 64 through the guide slots 78, thereby pushing the push bars 68 rearwardly towards the fixed jaw 6 and closing a jaw opening 110 to capture the workpiece W. After the production operation on the workpiece W is performed, the operator again toggles the three-way valve 108 whereby the linear actuator 22 retracts, retracting the jaw contact member 77 through a reverse procedure from that described above.

It is to be understood that while certain forms of the present invention have been illustrated and described herein, it is not to be limited to the specific forms or arrangement of parts described and shown.

What is claimed is:

1. A power-actuated jaw for a vise including first and second vise jaws, which assembly includes:

a push bar connected to said first vise jaw and having a first direction of movement toward and away from said second vise jaw;

a slide bar slidably connected to said push bar and slidably movable along a second direction of movement generally transverse to said push bar direction of movement;

a force transfer mechanism connected to said push and slide bars and adapted for transferring movement of said slide bar along said second direction of movement to movement of said push bar along said first direction of movement; and a housing having a proximate end adapted for mounting on said first vise jaw and a distal end located between said vise jaws.

2. The invention according to claim 1 wherein said housing includes first and second plates mounted in spaced relation with said push and slide bars located generally therebetween.

3. The invention according to claim 1, which includes a power actuator connected to said force transfer mechanism and adapted for applying an actuating force thereto.

4. The invention according to claim 3 wherein said power actuator comprises a linear actuator with a first, retracted position corresponding to an open/retracted position of said power-actuated jaw, and a second, extended position corresponding to a closed-extended position of said power-actuated jaw.

5. The invention according to claim 4 wherein said power actuator comprises a pneumatic piston-and-cylinder unit.

6. The invention according claim 1, which includes:

said force transfer mechanism including a pivot arm with first and second ends;

said pivot arm being pivotally connected to said housing intermediate said first and second ends;

said pivot arm first end being connected to said actuator; and said pivot arm second end being connected to said slide bar; and said pivot arm being rotatable between first and second positions corresponding to said open/retracted and said closed/extended jaw positions respectively.

7. The invention according to claim 2, which includes:

said one housing plate having a channel slidably receiving said slide bar.

8. A power-actuated jaw apparatus for a vise including first and second vise jaws, which actuated jaw includes:

a housing including a proximate end connected to said first vise jaw and a distal end positioned between said vise jaws;

said housing including a base mounted on said first vise jaw and first and second housing plates connected to said base and positioned in generally parallel, spaced relation;

a receiver formed between said plates;

a push bar selectively positioned at least partly in said receiver and having a first direction of movement toward and away from said second vise jaw;

a slide bar positioned at least partly in said receiver and slidably movable along a second direction of movement generally transverse to said first direction of movement;

a force transfer mechanism connected to said push and slide bars and adapted for transferring movement of said slide bar along said second direction of movement to movement of said push bar along said first direction of movement; and a power actuator mounted on said housing and having retracted and extended positions corresponding to said push bar retracted and extended positions respectively, said power actuator being connected to said slide bar and adapted for sliding same along said second direction of movement.

9. The invention according to claim 8, which includes:

a pair of said slide bars positioned in generally parallel, spaced relation; and a pair of said push bars positioned in generally parallel, spaced relation, said push bars being located generally between said slide bars within said receiver.

10. The invention according to claim 8, wherein said force transfer mechanism comprises a diagonal guide slot located in one of said slide and push bars and a guide pin mounted on and projecting laterally from the other of said slide and push bars, said guide pin being slidably received in said diagonal slot whereby said guide pin is adapted for extending and retracting said push bar in response to movement of said guide bar along said second direction of movement.

11. The invention according to claim 10, which includes:

each said push bar including multiple diagonal guide slots; and multiple guide pins extending through said slide bars, each said guide pin including opposite ends projecting laterally outwardly from a respective slide bar, and each said guide pin end being slidably received in a respective push bar slot.

12. The invention according to claim 9, which includes:

each said housing plate having a slot slidably receiving a respective slide bar.

13. The invention according to claim 8 wherein said force transfer mechanism includes:

a sliding subassembly including said push and slide bars; and a pivoting subassembly including a pivot arm with first and second ends, said pivot arm being pivotally connected to said housing base intermediate its first second ends, said pivot arm first end being connected to said actuator, said pivot arm second end being connected to said slide bar and said pivot arm being rotatable between first and second positions corresponding to said open/retracted and said closed/extended jaw positions respectively.

14. The invention according to claim 8 wherein said linear actuator comprises a pneumatic piston-and-cylinder unit.

15. The invention according to claim 14, which includes a compressed air source, a three-way valve connected to said compressed air source and first and second air supply lines connected to said three-way valve and to said first and second ends of said piston-and-cylinder unit respectively.

16. The invention according to claim 8, which includes a contact member mounted on said push bar in oppose relation to said second vise jaw across said vise jaw opening.

17. The invention according claim 8, which includes a mounting bolt extending through said housing base and into said first vise jaw, said mounting bolt mounting said power-actuated jaw on said vise.

18. A power-actuated jaw apparatus for a vise including first and second vise jaws, which actuated jaw includes:

a housing including a proximate end connected to said first vise jaw and a distal end positioned between said vise jaws;

said housing including a base mounted on said first vise jaw by a mounting bolt and having first and second base sides;

said housing including first and second plates connected to said base and positioned in generally parallel, spaced relation;

a receiver formed between said plates;

a force transfer mechanism including sliding and pivoting subassemblies;

said sliding subassembly including a pair of push bars selectively positioned at least partly in said receiver and having a first direction of movement toward and away from said second vise jaw and a pair of slide bars positioned at least partly in said receiver and slidably movable along a second direction of movement generally transverse to said first direction of movement, each said push bar including multiple diagonal guide slots;

said sliding subassembly further including a plurality of guide pins mounted on and extending between said slide bars, and each said guide pin being slidably received in a respective guide slot;

a contact member mounted on said push bars and adapted for engaging a workpiece in said jaw opening;

said pivoting subassembly including a pivot arm with first and second pivot arm ends, said pivot arm being pivotally connected to said housing base second end intermediate said pivot arm first second ends, said pivot arm second end being connected to said slide bars;

said pivot arm being rotatable between first and second positions corresponding to open/retracted and closed/extended jaw positions respectively;

a pneumatic piston-and-cylinder unit mounted on said housing and operatively connected to said pivot arm first end for rotating same between its first and second positions in response to retraction and extension of said piston-and-cylinder unit respectively;

a compressed air source; and a three-way valve connected to said compressed air source and to said piston-and-cylinder unit first and second ends for directing compressed air towards said piston-and-cylinder unit first and second ends respectively.

19. A power-actuated jaw for a vise including first and second vise jaws, which assembly includes:

a push bar adapted for connection to said first vise jaw and having a first direction of movement toward and away from said second vise jaw;

a slide bar slidably connected to said push bar and slidably movable along a second direction of movement generally transverse to said push bar direction of movement; and a force transfer mechanism connected to said push and slide bars and including a diagonal sliding engagement therebetween, said transfer mechanism being adapted for transferring movement of said slide bar along said second direction of movement to movement of said push bar along said first direction of movement.

20. The invention according to claim 19, which includes:

a diagonal guide slot formed in said push bar and including first and second push bar slot ends;

a guide pin mounted on said slide bar and slidably received in said slot; and said pin moving from said slot first end to said slot second end in response to movement of said slide bar along said second direction of movement, said pin sliding in said slot whereby said push bar is biased between its open/retracted and closed/extended positions.

* * * * *